US007927067B2

(12) United States Patent
Rajamani et al.

(10) Patent No.: US 7,927,067 B2
(45) Date of Patent: Apr. 19, 2011

(54) SYSTEM AND METHOD FOR CONTROLLING STATOR ASSEMBLIES

(75) Inventors: Ravi Rajamani, West Hartford, CT (US); Peter E. Chenard, Glastonbury, CT (US); Coy Bruce Wood, Ellington, CT (US)

(73) Assignee: United Technologies Corporation, Hartford, CT (US)

( * ) Notice: Subject to any disclaimer, the term of this patent is extended or adjusted under 35 U.S.C. 154(b) by 1022 days.

(21) Appl. No.: 11/799,251

(22) Filed: May 1, 2007

(65) Prior Publication Data

US 2008/0273965 A1 Nov. 6, 2008

(51) Int. Cl.
*F01D 17/16* (2006.01)

(52) U.S. Cl. ..... 415/118; 415/159

(58) Field of Classification Search ..... 415/118, 415/148, 155, 159
See application file for complete search history.

(56) References Cited

U.S. PATENT DOCUMENTS

| | | | | |
|---|---|---|---|---|
| 3,604,259 | A | 9/1971 | Heinsohn et al. | |
| 3,617,014 | A | 11/1971 | Warren | |
| 3,814,537 | A | 6/1974 | Stoltman | |
| 3,937,588 | A | 2/1976 | Kisslan | |
| 4,071,820 | A | 1/1978 | Mushinsky | |
| 4,197,699 | A | 4/1980 | Parker et al. | |
| 4,384,819 | A * | 5/1983 | Baker | 415/14 |
| 4,423,594 | A | 1/1984 | Ellis | |
| 4,641,517 | A * | 2/1987 | Spock et al. | 73/112.01 |
| 4,756,229 | A | 7/1988 | Drakeley | |
| 4,768,338 | A * | 9/1988 | Lindler et al. | 60/39.27 |
| 5,042,245 | A | 8/1991 | Zickwold, Jr. | |
| 5,168,447 | A * | 12/1992 | Moore | 701/99 |
| 5,224,820 | A * | 7/1993 | Brichet et al. | 415/150 |
| 6,452,158 | B1 | 9/2002 | Whatley et al. | |
| 6,487,491 | B1 | 11/2002 | Karpman et al. | |
| 7,096,657 | B2 | 8/2006 | Mahoney et al. | |
| 7,568,339 | B2 * | 8/2009 | Noelle et al. | 60/605.1 |

* cited by examiner

*Primary Examiner* — Nathaniel Wiehe
(74) *Attorney, Agent, or Firm* — Kinney & Lange, P.A.

(57) ABSTRACT

A variable vane control system for use with a gas turbine engine includes a plurality of vanes, an actuation assembly, a mechanical linkage assembly, and a sensor. Each of the plurality of vanes has an airfoil portion disposed in a gas flowpath of the gas turbine engine, and a position of each of the vanes is adjustable with respect to an angle of attack of the airfoil portion of each vane. The actuation assembly is configured for generating actuation force to position the plurality of vanes. The mechanical linkage assembly operably connects the actuation assembly to at least one of the plurality of vanes. The sensor is configured to sense at least one of the position of the airfoil portions of the plurality of vanes and the mechanical linkage assembly, and to generate a position output signal.

19 Claims, 3 Drawing Sheets

SYSTEM AND METHOD FOR CONTROLLING STATOR ASSEMBLIES

BACKGROUND

The present invention relates to systems and methods for controlling variable vane stator assemblies for gas turbine engines.

Gas turbine engines often include stator assemblies with variable-position vanes, which are sometimes referred to as variable vane or vari-vane assemblies. These stator assemblies are positioned in a primary engine gaspath, and can be located in a cold section of an engine, such as in a compressor section. The vanes of the stator assembly are static in the sense of being non-rotating parts, but are variable in their angle of attack relative to fluid flow in the primary engine gaspath, the variation of which adjusts an effective area between adjacent vanes in the stator assembly. Typically, all of the vanes are connected to a single positioning ring through conventional mechanical coupling mechanisms generally located outside the primary engine gaspath. The position of all of the vanes can be affected simultaneously by moving a positioning ring. Movement of the positioning ring is produced using an hydraulic actuator having a piston that is mechanically coupled to the positioning ring through a bellcrank, lever or other conventional mechanical coupling mechanism assemblies.

Known stator assemblies allow detection of a position of the actuator piston. Positions of the positioning ring and the vanes are not sensed directly, but instead only the position of the actuator piston is detected. This approach is not very precise, because it assumes that movement of the actuator piston translates perfectly into movement of the vanes and positioning ring through extensive mechanical linkages according to original design specifications. However, wear, damage, engine operating conditions, and other factors may cause the actual positions of vanes or positioning rings to deviate from anticipated positions under perfect conditions.

SUMMARY

A variable vane control system for use with a gas turbine engine includes a plurality of vanes, an actuation assembly, a mechanical linkage assembly, and a sensor. Each of the plurality of vanes has an airfoil portion disposed in a gas flowpath of the gas turbine engine, and a position of each of the vanes is adjustable with respect to an angle of attack of the airfoil portion of each vane. The actuation assembly is configured for generating actuation force to position the plurality of vanes. The mechanical linkage assembly operably connects the actuation assembly to at least one of the plurality of vanes. The sensor is configured to sense the position of at least one of a plurality of vanes and the mechanical linkage assembly, and to generate a position output signal.

DETAILED DESCRIPTION

In general, the present invention provides a system and method for sensing and controlling the positions of vanes in a stator assembly of a gas turbine engine. The positions of airfoils, positioning rings, bellcranks, levers, coupling mechanisms, or other structures of the stator assembly can be monitored in order to sense vane position. The present invention thus provides a relatively precise indication of actual vane position relative to a primary gas flowpath in essentially real time, and decreases or eliminates reliance upon assumptions of vane position that are based upon a blueprint mechanical configuration of the stator assembly. In other words, the present invention permits more direct sensing of vane positioning. The system and method of the present invention further enables dynamic adjustment of the positioning of the vanes based upon comparison between a sensed vane position feedback signal (or signals) and a position command signal that indicates desired vane positioning.

Figure 1:
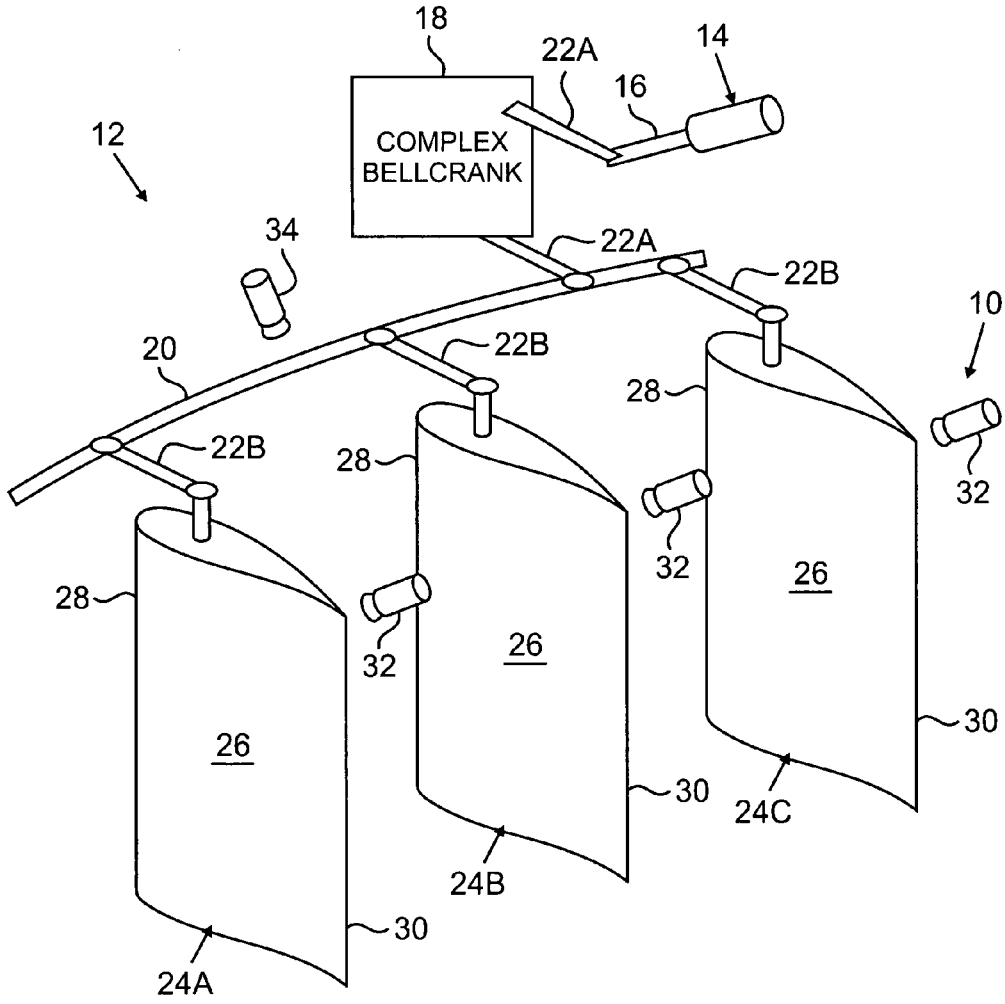
FIG. 1 is a schematic perspective view of a sensor system according to the present invention.

FIG. 1 is a schematic perspective view of a sensor system 10 for a stator assembly 12 of a gas turbine engine (only a portion of the stator assembly 12 is shown). The stator assembly 12 includes an actuator 14 (e.g., a hydraulic actuator) having an actuator piston 16, a complex bellcrank 18, a positioning ring 20, additional coupling mechanisms 22A and 22B, and a plurality of vanes collectively designated by the reference number 24 (in FIG. 1, only three vanes 24A-24C are shown for simplicity). Each vane 24 includes an airfoil portion 26 that defines a leading edge 28 and a trailing edge 30. In the illustrated embodiment, the sensor system 10 includes an airfoil position sensor 32 for each of the vanes 24, and a position ring sensor 34.

The stator assembly 12 enables variable positioning of the vanes 24 relative to fluid flow of a primary flowpath of the gas turbine engine. As will be understood by those of ordinary skill in the art, the vanes 24 are static in the sense of being essentially non-rotating engine components (as opposed to rotating turbine blades), but have a variable angle of attack for adjusting an effective area between adjacent vanes 24 in the stator assembly 12. The actuator 14, in response to a control signal, produces mechanical force used to position the vanes 24 as desired. The coupling mechanisms 22A mechanically link the piston 16 of the actuator 14 to the positioning ring 20 via the bellcrank 18, and the coupling mechanism 22B mechanically links the positioning ring 20 to each of the vanes 24. Movement of the actuator piston 16 thereby causes substantially simultaneous movement of all of the vanes 24. The mechanical connecting structures of the stator assembly 12 are shown in simplified schematic form in FIG. 1, but it should be recognized that the configuration of stator assemblies 12, and in particular the configuration of the mechanical connecting structures (e.g., the bellcrank 18, the coupling mechanisms 22A and 22B, etc.), can vary from the illustrated embodiment as desired for particular applications. Alternative vane actuation arrangements, without the positioning ring 20, are envisioned as well. A person of ordinary skill in the art will appreciate that the present invention is also applicable to such alternative vane actuation arrangements.

Figure 2:
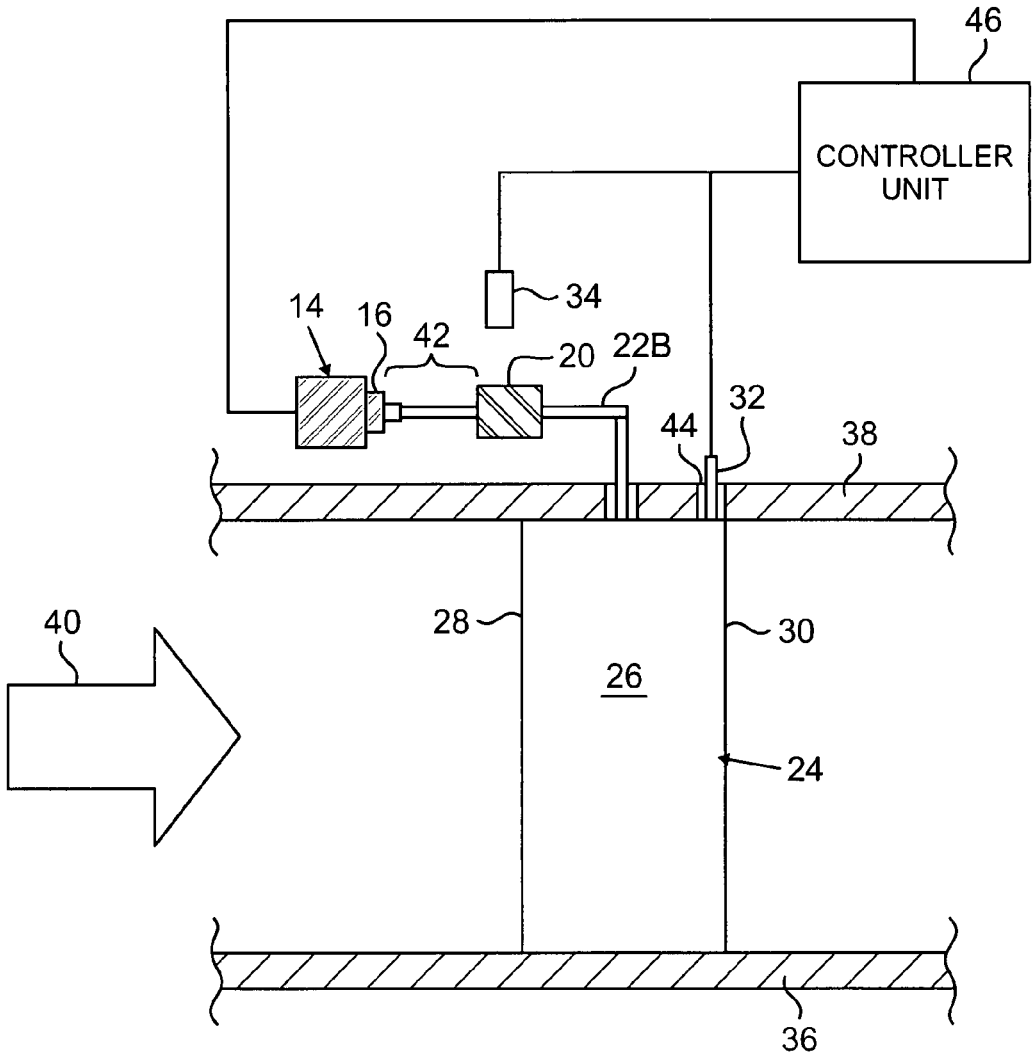
FIG. 2 is a schematic cross-sectional view of the sensor system.

FIG. 2 is a schematic cross-sectional view of the sensor system 10 and the stator assembly 12. As shown in FIG. 2, a primary gaspath is defined between an inner case 36 and an outer case 38, and an exemplary fluid flow 40 through the primary gaspath is illustrated. The airfoil portions 26 extend into the primary gaspath, and interact with the fluid flow 40. For simplicity, the bellcrank 18 and coupling mechanism 22A are collectively designated as coupling mechanism 42 hereinafter.

As shown in FIGS. 1 and 2, the sensor system 10 includes non-contacting sensors 32 and 34 for sensing positions of the vanes 24. The sensors 32 are positioned adjacent to the airfoil portions 26 of the vanes 24 to detect a standoff distance between each sensor 32 and a surface of the corresponding airfoil portion 26. The sensors 32 can be of any suitable type for determining a standoff distance, for example, optical sensors, microwave sensors, eddy current sensors, ultrasonic sensors, and other known types of sensors can be utilized. The type of sensor used for a particular application can be selected based upon the particular conditions of that application. The sensors 32 can be exposed to the primary gaspath through the inner or outer case 36 or 38. As shown in FIG. 2, the sensors 32 are exposed to the primary gaspath through openings 44 in the outer case 38. The sensors 32 can be angled to adequately address the airfoils 26 while also limiting undesired disruption of the fluid flow 40 in the primary gaspath. In one embodiment, the sensors 32 are positioned at the trailing edges 30 of the airfoils 26, at either a pressure or suction side of the airfoil portion 26. However, it should be understood that the sensors 32 can be positioned elsewhere to face other regions of the airfoils 26 in alternative embodiments. In the illustrated embodiment, a sensor 32 is provided for each vane 24 in the stator assembly 12. However, in order to reduce the cost and complexity of the sensor system 10, fewer sensors 32 can be utilized and positioned only adjacent to selected airfoil portions 26. For example, only a single sensor 32 can be used or a relatively small number of substantially equally circumferentially spaced sensors 32 can be used, and in these instances the position of the selected airfoil portions 26 can be directly sensed and the positions of the other airfoil portions 26 can be determined based upon the mechanical relationships of the vanes 24 (e.g., all vanes 24 can be presumed to move simultaneously and identically).

The sensor 34 is positioned adjacent to the positioning ring 20, outside the primary gaspath, in order to detect a position of the ring 20. The sensor 34 can be of any type, such as one of the types described above with respect to the sensors 32. The sensor 34 enables sensing the positions of the vanes 34 indirectly, by directly sensing the position of the positioning ring 20 and enabling the positions of the vanes 24 to be determined based upon the mechanical relationship of the vanes 24 to the positioning ring 20.

The sensor system 10 can utilize both sensors 32 and 34 as described above. However, it should be understood that fewer sensors can be used than are shown in the exemplary embodiment illustrated in FIGS. 1 and 2. For example, the sensor system 10 of the present invention could utilize only the sensor 34 adjacent to the positioning ring 20 for sensing vane position, or, alternatively, only one or more of the sensors 32 adjacent to the airfoil portions 26 can be used for sensing vane position. While the use of great numbers of sensors can increase the amount of positioning information available, and provide more precise positioning feedback, the use of greater numbers of sensors may be cost-prohibitive in some applications. However, regardless of the number of sensors used, the present invention provides advantages over prior art stator assemblies, by limiting or eliminating reliance upon assumed mechanical relationships and part configurations from original blueprint specifications.

The sensors 32 and 34 are operably connected to a controller unit 46, which receives vane position feedback signals from the sensors 32 and 34. The controller unit 46 is also operably connected to the actuator 14, and can send control signals to the actuator 14 for controlling movement of the actuator piston 16. As explained further below, the controller unit 46 can utilize position feedback to dynamically adjust the control signals to harmonize position feedback with desired vane positioning.

Figure 3:
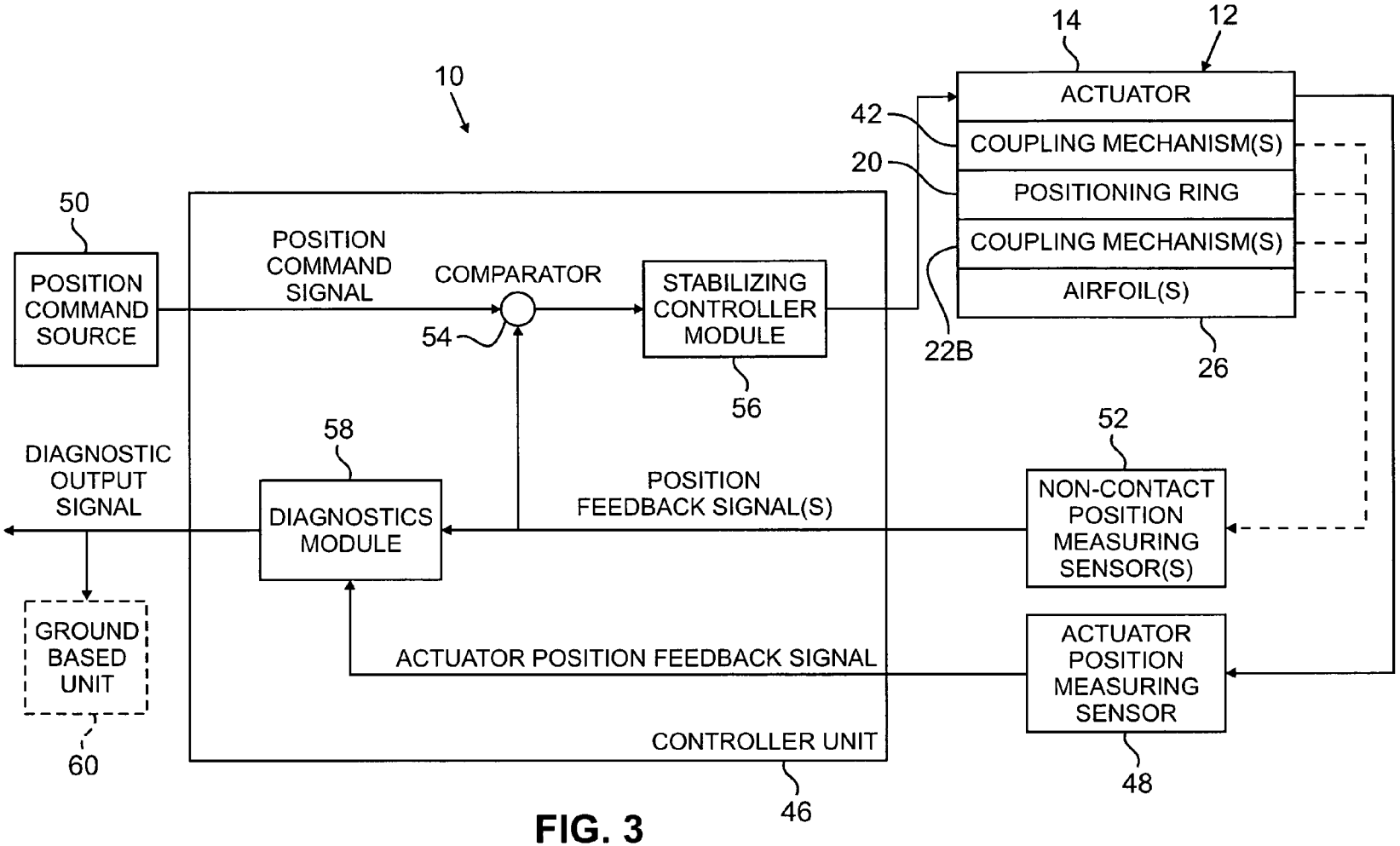
FIG. 3 is a block diagram of the sensor system.

FIG. 3 is a block diagram of the sensor system 10, which further includes an optional actuator position measuring sensor 48 and a position command source 50. As shown in FIG. 3, the sensors 32 and 34 are collectively designated as non-contact position measuring sensor(s) 52, which can include one or more sensors positioned adjacent to the coupling mechanism(s) 42, the positioning ring 20, the coupling mechanism(s) 22B, and/or the airfoil(s) 26. The actuator position measuring sensor 48 is of a type known in the prior art for detecting a position of the actuator piston 16 (not shown in FIG. 3). The position command source 50 is the source of a position command signal (or reference signal) sent to the controller unit 46 designating desired vane positioning, and can be a module of an electronic engine controller (EEC). It should be noted that the controller unit 46 can be integrated with the EEC of the gas turbine engine, or can be a separate stand-alone component.

The controller unit 46 includes a comparator 54, a stabilizing controller module 56, and a diagnostics module 58. The non-contact position measuring sensor(s) 52 each generate a position feedback signal, indicating actual sensed vane position as described above, that are sent to both the comparator 54 and the diagnostics module 58. The comparator 54 compares the position feedback signal(s) with the position command signal from the position command source 50, indicating desired vane positioning, and then generates a bias signal sent to the stabilizing controller module 56. The stabilizing controller module 56 interprets the bias signal, determines if adjustment of actual vane position is necessary, and sends appropriate control signals to the actuator 14 in order to harmonize actual positions of the vanes 24 (associated with the position feedback signal(s)) with desired positions of the vanes 24 (associated with the position command signal).

The actuator position measuring sensor 48 generates an actuator position feedback signal that is sent to the diagnostics module 58 along with the position feedback signal(s) from the non-contact position measuring sensor(s) 52. The diagnostics module 58 can generate a diagnostic output signal, which can indicate a health condition of the stator assembly 12 of the gas turbine engine. The diagnostics module 58 can generate the diagnostic output signal on demand, such as during a regular maintenance interval when diagnostic equipment is connected to the controller unit 46. Alternatively, the diagnostic output signal could be sent to the EEC on a periodic or substantially continuous basis. Furthermore, the diagnostics module 58 can electronically store position data over time, enabling tending data to be collected and included with the diagnostic output signal. Thus, the diagnostics module 58 facilitates engine health monitoring and maintenance, and can help identify vane positioning error sources in the stator assembly 12.

In one embodiment, the diagnostics module 58 can be used to only record a limited amount of position data over time, and can have the ability to transmit that position data on a periodic basis to an optional ground based unit 60 (e.g., wirelessly or through a periodic physical uplink) that could store and trend all the historic position data. This would allow a cost effective solution where the on-board controller unit 46 could be less complex and memory storage and decision making capabilities would primarily reside on the ground (with the ground based unit 60).

Although the present invention has been described with reference to preferred embodiments, workers skilled in the art will recognize that changes may be made in form and detail without departing from the spirit and scope of the invention.

What is claimed is:

1. A variable vane control system for use with a gas turbine engine, the system comprising:

a plurality of vanes each having an airfoil portion disposed in a gas flowpath of the gas turbine engine, wherein a position of each of the vanes is adjustable with respect to an angle of attack of the airfoil portion of each vane;

an actuation assembly for generating actuation force to position the plurality of vanes;

a mechanical linkage assembly for operably connecting the actuation assembly to at least one of the plurality of vanes; and a sensor configured to directly sense the position of a trailing edge portion of the airfoil portion of a first of the plurality of vanes, and to generate a position output signal.

2. The system of claim 1 and further comprising:

control circuitry electrically connected to the sensor and to the actuation assembly, wherein the control circuitry commands the actuation assembly to adjust the positioning of at least one of the plurality of vanes as a function of the position output signal from the sensor.

3. The system of claim 1, wherein the sensor is of a type selected from the group consisting of: optical sensors, microwave sensors, eddy current sensors and ultrasonic sensors.

4. The system of claim 2, wherein the control circuitry is configured to electronically store position output signals over time.

5. The system of claim 1 and further comprising:

diagnostic circuitry electrically connected to the sensor for generating a diagnostic output as a function of trends in position output signals gathered over time.

6. The system of claim 1 and further comprising:

a ground based processing unit operably connected to the sensor for generating a diagnostic output as a function of trends in position output signals gathered over time.

7. The system of claim 1, wherein the actuation assembly is configured to simultaneously adjust the positioning of each of the plurality of vanes operably connected to the linkage assembly.

8. The system of claim 7 and further comprising:

a linkage sensor, wherein the linkage sensor senses the position of the airfoil portions of the plurality of vanes indirectly by sensing the position of a portion of the linkage assembly to which at least one of the plurality of vanes is operably connected.

9. The system of claim 1, wherein the sensor is a non-contacting type sensor.

10. The system of claim 1, wherein the sensor is angled with respect to the gas flowpath.

11. A variable vane control system for use with a gas turbine engine, the system comprising:

a plurality of vanes each having an airfoil portion, wherein an angle of attack of the airfoil portion of each vane is adjustable such that a position of each vane is variable;

an actuation assembly for controlling the positioning of the plurality of vanes;

a linkage assembly for mechanically connecting the actuation assembly to the plurality of vanes; and a sensor configured to sense the position of the airfoil portion of at least one of the plurality of vanes, and to generate a position output signal, wherein the sensor is configured to directly sense the position of a trailing edge portion of the airfoil portion of a first of the plurality of vanes; and control circuitry electrically connected to the sensor and to the actuation assembly, wherein the control circuitry commands the actuation assembly to adjust the positioning of at least one of the plurality of vanes as a function of the position output signal from the sensor.

12. The system of claim 11, wherein the sensor is of a type selected from the group consisting of: optical sensors, microwave sensors, eddy current sensors and ultrasonic sensors.

13. The system of claim 11, wherein the control circuitry is configured to electronically store position output signals over time.

14. The system of claim 11 and further comprising:

diagnostic circuitry electrically connected to the sensor for generating a diagnostic output as a function of trends in position output signals gathered over time.

15. The system of claim 11 and further comprising:

a ground based processing unit operably connected to the sensor for generating a diagnostic output as a function of trends in position output signals gathered over time.

16. The system of claim 11 and further comprising:

a linkage sensor, wherein the linkage sensor senses the position of the airfoil portions of the plurality of vanes indirectly by sensing the position of a portion of the linkage assembly to which at least one of the plurality of vanes is mechanically connected.

17. The system of claim 11, wherein the sensor is a non-contacting type sensor.

18. The system of claim 11, wherein the sensor is angled with respect to the trailing edge portion of the airfoil portion of a first of the plurality of vanes.

19. A method of controlling variable vane airfoil positioning in a gas turbine engine, the method comprising:

providing a position reference signal that identifies a desired position of a vane airfoil;

sensing an actual position of the vane airfoil as a function of a standoff distance measured between a sensor and a trailing edge portion of the vane airfoil;

generating an actual position signal;

comparing the position reference signal and the actual position signal; and adjusting the actual position of the vane airfoil as a function of the comparison of the position reference signal and the actual position signal.

* * * * *